United States Patent [19]

Lustig et al.

[11] Patent Number: 4,691,775

[45] Date of Patent: Sep. 8, 1987

[54] ISOLATION VALVE WITH FRANGIBLE FLAPPER ELEMENT

[75] Inventors: Lee M. Lustig, Garland; Gary D. Ellis, Richardson, both of Tex.

[73] Assignee: Dresser Industries, Inc., Dallas, Tex.

[21] Appl. No.: 843,910

[22] Filed: Mar. 25, 1986

[51] Int. Cl.[4] ..... E21B 34/10

[52] U.S. Cl. ..... 166/317; 166/325

[58] Field of Search ..... 166/317, 318, 332, 334, 166/319–321, 325

[56] References Cited

U.S. PATENT DOCUMENTS

| | | | |
|---|---|---|---|
| 1,569,293 | 1/1926 | Miller | 166/317 X |
| 2,263,412 | 11/1941 | Armentrout | 166/317 X |
| 2,565,731 | 8/1951 | Johnston | 166/317 X |
| 2,636,563 | 4/1953 | Rollins | 166/317 |
| 3,190,357 | 6/1965 | Kirk | 166/317 X |
| 3,599,713 | 8/1971 | Jenkins | 166/368 |
| 3,831,680 | 8/1974 | Edwards et al. | 166/317 X |
| 3,980,134 | 9/1976 | Amancharla | 166/317 X |
| 4,134,455 | 1/1979 | Read | 166/334 |
| 4,220,206 | 9/1980 | Van Winkle | 166/317 X |
| 4,237,980 | 12/1980 | Robinson | 166/317 X |
| 4,286,662 | 9/1981 | Page, Jr. | 166/317 |
| 4,378,847 | 4/1983 | Patel et al. | 166/317 |
| 4,393,930 | 7/1983 | Ross et al. | 166/317 X |
| 4,423,773 | 1/1984 | Stout | 166/317 X |
| 4,457,376 | 7/1984 | Carmody et al. | 166/332 |
| 4,541,484 | 9/1985 | Salerni et al. | 166/317 X |

*Primary Examiner*—James A. Leppink
*Assistant Examiner*—Thuy M. Bui

[57] ABSTRACT

An isolation valve that may be inserted in the casing of a subterranean well at a position above a production formation and operated to a closed position upon the withdrawal of the mandrel and wash tube commonly employed for effecting the gravel packing of the screen and production formation. The valve has a frangible flapper piercable by mechanical means or by increased pressure after removal of the wash tube.

8 Claims, 2 Drawing Figures

ISOLATION VALVE WITH FRANGIBLE FLAPPER ELEMENT

TECHNICAL FIELD

The invention relates to an isolation valve that may be inserted in the casing of a subterranean well. The valve has a frangible flapper element piercable by mechanical means or by increased pressure after removal of the wash tube.

BACKGROUND ART

A number of operations are performed in the completion and maintenance of subterranean wells that require the introduction of fluids into the well and the production formation for specific purposes. For example, subsequent to gravel packing, completion fluids are introduced to the well to displace the fluid used during the gravel packing procedure. When the gravel packing and completion fluid introduction operations are completed, it is, of course, necessary to remove the wash tube of the gravel packing apparatus and, in particular, the tubular work string carrying such apparatus, and substantial quantities of completion fluid are normally contained in the removed apparatus. It is, therefore, desirable to prevent the loss of such costly fluid by flow into the formation upon the removal of the tubular work string and the associated gravel packing apparatus from the well.

There is, therefore, a need for a valve which may be conveniently inserted into the well casing in an open position above a production formation so that a wash tube of a gravel packing apparatus may be readily inserted through the open valve to extend to a position adjacent the production formation. Such valve should be automatically closeable by the withdrawal of the wash string from the well. Means for the reliable reopening of the valve for production or further work must also be provided.

SUMMARY OF THE INVENTION

In general, the invention provides a pivotable flapper valve assembly mounted in a tubular valve housing which, in turn, is located in the casing of a well at a position above a production formation. The flapper valve is mounted on a horizontally pivoted arm and is pivotable between an open and closed position. The valve housing includes a cut-out window portion to accommodate the flapper valve in the open position such that maximum clearance can be maintained for tools extending through the valve. The flapper valve includes a frangible element which is disposed for piercing or shattering when the flapper valve is in the closed position. Preferably, the frangible element is made of tempered glass. The frangible element can be of a predetermined thickness such that breakage of the element can be achieved solely by a predetermined amount of pressure applied from above.

BRIEF DESCRIPTION OF THE DRAWINGS

A more complete understanding of the invention and its advantages will be apparent from the following Detailed Description taken in conjunction with the accompanying Drawings in which.

DETAILED DESCRIPTION

Figure 1:
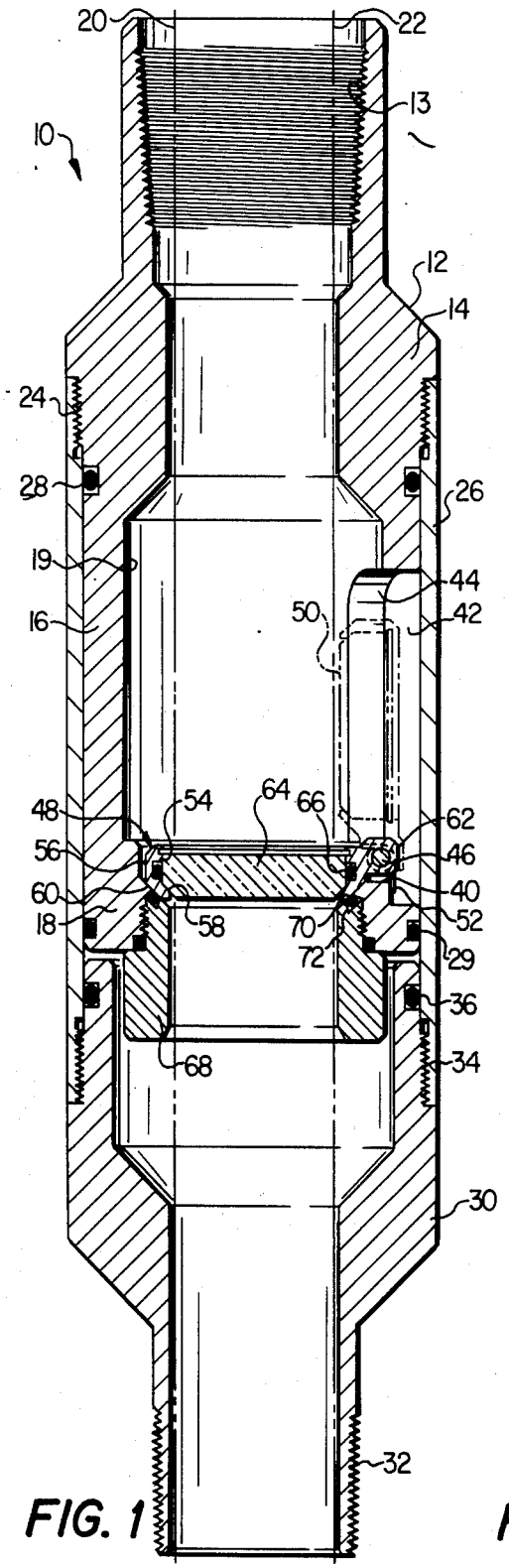
FIG. 1 is a partially broken away elevation view of an isolation valve constructed in accordance with the present invention.
Figure 2:
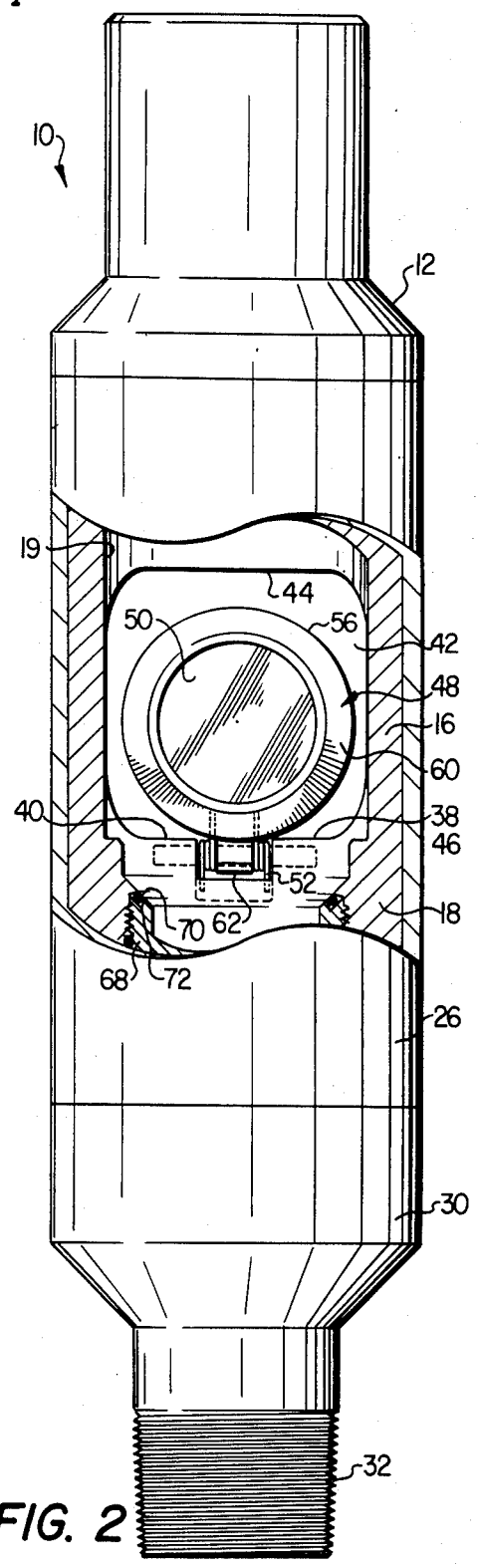
FIG. 2 is the isolation valve of FIG. 1 rotated 90° in a partially broken away elevation view.

Referring to FIGS. 1 and 2, where like numerals indicate like and corresponding elements, valve 10 includes an upper tubular member 12 having threads 13 for engagement with a tubing string (not shown). Upper tubular member 12 includes an upper section 14, a medial section 16 and a lower section 18. Medial section 16 includes a semi-cylindrical wall 18 which defines a cavity within valve 10. Lines 20 and 22 define the nominal inside diameter of the valve, which determines the maximum diameter of a tool which can pass through the valve.

Upper tubular member 12 includes threads 24 for attachment to tubular flapper housing 26. O-rings 28 and 29 are provided to seal the connection between upper tubular member 12 and tubular flapper housing 26. Isolation valve 10 also includes lower tubular member 30, with threads 32 on the lower portion thereof for connection to the tubing string (not shown) and an additional set of threads 34 at the upper portion thereof for connection to the tubular flapper housing 26. O-ring 36 is provided to seal the connection between the tubular flapper housing 26 and the lower tubular member 30.

Upper tubular member 12 includes a pair of upstanding flapper valve pin retainers 38 and 40, as is best shown in FIG. 2. The flapper pin retainers 38 and 40 are disposed adjacent to and extend upwardly from the lower portion 18 of upper tubular member 12. Semi-cylindrical wall 18 includes a cut-out window 42 defined by wall 44 in medial portion 16. Flapper valve pin retainers 38 and 40 extend upwardly into the window 42, and include shoulders for defining a gap in approximately the center of window 42.

Pin 46 is retained by flapper valve pin retainers 38 and 40 and extends across the gap defined by the shoulders thereof. Pivotably attached to pin 46 is flapper valve 48, which is pivotable between a closed position shown in FIG. 1 and an open position shown in FIG. 2 and in phantom lines in FIG. 1. In the open position, flapper 48 is at least partially located within window 42 such that the innermost edge 50 of flapper 48 clears line 22. Spring 52 is provided to bias flapper 48 in the closed position.

Flapper 48 includes inner wall 54 and outer wall 56, which have circular cross sections. Inner wall 54 includes a tapered portion 58, and outer wall 56 includes a frustro-conical portion 60. Arm 62 extends from the outer wall 56 of flapper 48 for the pivotable, pinned attachment to upper tubular member 12.

Inner wall 54 and tapered portion 58 restrain a frangible member 64, which in the preferred embodiment is constructed of tempered float glass. O-ring 66 is provided to seal frangible element 64 within flapper 48.

Plug 68 is threadably connected to the lower portion of upper tubular member 12, and includes a frustro-conical face in the upper portion thereof adapted for sealing engagement with the frustroconical face 60 of flapper valve 48. O-ring 70 is restrained within groove 72 and plug 68. The frustro-conical walls of the flapper and plug, in combination with O-ring 70, provide for sealing when flapper 48 is in the closed position In operation, isolation valve 10 isolates fluid above the valve from the formation below until the well is to be put on production. The flapper moves to the closed position from the open position under force of spring 52 when the mandrel and wash pipe commonly employed for gravel packing is removed. The valve prevents the formation from taking fluid when the gravel pack wash tube is removed by holding the column of fluid above the perforations of the well bore. This feature eliminates the possibility of putting the well on a vacuum, and enables the gravel packing of more wells than previously possible without the isolation valve.

The isolation valve is run into the well in its open position with the wash pipe through the inner diameter of the valve. Once the gravel packing of the well is completed, the wash pipe is pulled up to allow the flapper to fall down on its seat and seal off. Then the gravel pack tubing is pulled out of the well, and the hydrostatic column of fluid cannot fall to the well perforations and be taken in by the formation, because the flapper is closed.

A key feature of the invention is the provision of window 42 to accommodate the flapper when it is in its open position. This enables maximization of the inner diameter of the isolation valve. Similarly, it is desirable to maximize the size of the frangible element, such that when it is pierced or shattered the flow restriction through the valve is minimized.

In preferred form, the frangible element is manufactured from tempered float glass, which explodes into fine fragments when broken by a pressure differential from above. Alternatively, the frangible element can be ruptured by running a special wireline tool to impact the frangible element, which is under pressure insufficient to shatter the frangible element. The special wireline tool includes a sinker bar and a star-bit. The tool is jarred on the frangible element until it breaks.

Thickness determines the pressure under which a tempered glass frangible element will shatter. It has been found that a $\frac{5}{8}$ inch thick element will break at 4,000 psi, and $\frac{3}{4}$ inch thick element will break at 6,000–7,000 psi, and a $\frac{7}{8}$ inch thick frangible element will break at 8,000–10,000 psi pressure. These breaking pressures are applicable when the element is at approximately 200° F.

While only one embodiment of the present invention has been described in detail herein and shown in the accompanying drawings, it will be evident that various further modifications are possible without departing from the scope of the invention.

We claim:

1. An isolation valve comprising:

(a) a tubular member;

(b) a flapper mounted for pivotal movement within the tubular member between a closed and an open position;

(c) the flapper including a frangible member disposed for reopening when the flapper is in the sealing position.

2. The isolation valve of claim 1 wherein the flapper further includes a body member having means for pivotal attachment to the tubular member and means for fixed attachment to the periphery of the frangible member.

3. The isolation valve of claim 2 wherein the frangible member is constructed of tempered glass.

4. The isolation valve of claim 1 wherein the frangible member is disposed for piercing by mechanical means from above when in the closed position.

5. The isolation valve of claim 1 wherein the frangible member is of a predetermined thickness for reopening at a predetermined differential pressure across the valve.

6. The isolation valve of claim 2 wherein the means for pivotal attachment includes an arm extending radially from the body member, the body member being a ring-shaped member with an inner wall adapted to restrain the frangible member and an outer wall for sealing engagement with the tubular member in the closed position.

7. An isolation valve comprising:

an upper tubular member having walls defining a window therein;

a flapper valve pivotably connected to the upper tubular member for movement between an open and a closed position, the flapper valve including a tempered glass frangible element and a sealing face;

the upper tubular member further including a sealing face for sealing engagement with the sealing face on the flapper when it is in the closed position;

a tubular flapper housing connected to the upper tubular member;

a lower tubular member connected to the tubular flapper housing; and the upper tubular member and the lower tubular member having inner walls defining an inner diameter of the valve, and the innermost surface of the flapper valve and frangible element clearing the inner diameter of the isolation valve when the flapper valve is in the open position.

8. An isolation valve comprising:

an upper tubular member having threads for engagement with a tubing string, having a pair of upstanding flapper valve pin retainers disposed adjacent the lower portion of the upper tubular member, and having walls in the medial portion of the upper tubular member defining a window with the flapper valve pin retainers extending upwardly into the window along the lower edge thereof;

a tubular flapper housing sealingly connected to the upper tubular member at the upper portion thereof and extending downwardly, enclosing the lower and medial portions of the upper tubular member, and having a lower portion extending downwardly to a plane below the lower portions of the upper tubular member;

a lower tubular member having threads for engagement with a tubing string and being sealingly connection at the upper portion thereof to the lower portion of the tubular flapper housing;

a flapper valve having inner and outer walls with circular cross-sections and an arm extending from the outer wall pivotably attached to the flapper valve pin retainers of the upper tubular member, such that the flapper valve is pivotable from a closed position to an open position wherein the flapper valve is at least partially located within the window of the upper tubular member;

a tempered glass disk sealingly retained by the inner wall of the flapper valve and restrained from downward movement when in the closed position by a tapered lower portion of the inner wall;

a plug being threadably connected to the lower portion of the upper tubular member and having walls defining a groove along a frustro-conical face in the upper portion thereof, the flapper valve outer wall including a frustro-conical face adapted for sealing engagement with the plug frustro-conical face, and the groove restraining means for sealing the flapper valve to the plug.

* * * * *